US008191897B2

(12) United States Patent
Ritner, Jr. et al.

(10) Patent No.: US 8,191,897 B2
(45) Date of Patent: Jun. 5, 2012

(54) CARD GAME AND METHOD OF PLAYING THE SAME

(76) Inventors: Roy R. Ritner, Jr., Scotts Valley, CA (US); Lynn Ehrlich, New York, NY (US)

( * ) Notice: Subject to any disclaimer, the term of this patent is extended or adjusted under 35 U.S.C. 154(b) by 2276 days.

(21) Appl. No.: 10/323,455

(22) Filed: Dec. 18, 2002

(65) Prior Publication Data

US 2003/0114209 A1 Jun. 19, 2003

Related U.S. Application Data

(60) Provisional application No. 60/341,994, filed on Dec. 18, 2001.

(51) Int. Cl.
*A63F 1/00* (2006.01)

(52) U.S. Cl. ..... 273/292; 273/274; 463/16; 463/13

(58) Field of Classification Search ..... 463/12, 463/13, 16; 273/292, 274
See application file for complete search history.

(56) References Cited

U.S. PATENT DOCUMENTS

| | | | | |
|---|---|---|---|---|
| 5,294,128 | A * | 3/1994 | Marquez | 273/292 |
| 5,653,444 | A * | 8/1997 | Dahl | 273/274 |
| 5,810,354 | A * | 9/1998 | Banyai | 273/292 |
| 6,007,424 | A * | 12/1999 | Evers et al. | 463/13 |
| 6,113,103 | A | 9/2000 | Mostashari | |
| 6,345,823 | B1 * | 2/2002 | Webb | 273/292 |
| 6,443,455 | B1 * | 9/2002 | Webb | 273/274 |
| 6,508,470 | B1 | 1/2003 | Yuan | |

* cited by examiner

*Primary Examiner* — Dmitry Suhol
*Assistant Examiner* — Andrew Kim
(74) *Attorney, Agent, or Firm* — Greenberg Traurig

(57) ABSTRACT

A card game based on the well-known game of Pai Gow Poker is played with five cards which players arrange into a three-card hand and a two-card hand. The three-card hand includes slightly modified poker rankings. In order to win a primary wager, the player's three-card hand and two-card hand must beat the dealer's corresponding three-card hand and two-card hand. Additionally, players may place an independent secondary wager that is related to the poker ranking of the five cards received by the player or the relationship between the two-card hand and three-card hand. A preestablished pay table defines the secondary wager winning combinations and corresponding payouts. A bad beat jackpot is also an option. With only five cards to deal and arrange, the embodiments of the disclosed game are played faster than Pai Gow Poker thereby increasing the casino's revenue generating ability and player interest.

26 Claims, 4 Drawing Sheets

310 320 300

| | PAY TABLE 1 |
|---|---|
| 5-CARD HAND | PAYS (TO 1) |
| PAIR OF KINGS OR BETTER | 2 |
| TWO PAIR | 3 |
| 3 OF A KIND | 6 |
| STRAIGHT | 15 |
| FLUSH | 25 |
| FULL HOUSE | 40 |
| 4 OF A KIND | 200 |
| STRAIGHT FLUSH | 2500 |
| ROYAL FLUSH | 20000 |

FIG. 4

410 420 400

| | PAY TABLE 2 |
|---|---|
| 5-CARD HAND | PAYS (TO 1) |
| PAIR OF KINGS OR BETTER | 2 |
| TWO PAIR | 3 |
| 3 OF A KIND | 6 |
| STRAIGHT | 15 |
| FLUSH | 25 |
| FULL HOUSE | 40 |
| 4 OF A KIND | 200 |
| STRAIGHT FLUSH | 2500 |
| ROYAL FLUSH | 10000 |

FIG. 5

CARD GAME AND METHOD OF PLAYING THE SAME

CROSS REFERENCE TO RELATED APPLICATIONS

This application claims the benefit of U.S. Provisional Application No. 60/341,994, filed Dec. 18, 2001.

FIELD OF THE INVENTION

The present invention relates to a casino style game. More particularly, a card game having wagering features is disclosed.

BACKGROUND

As the popularity of gaming escalates, more and more jurisdictions have legalized gaming in an effort to generate governmental funds in the form of gaming taxes. With the increase in the number of gaming jurisdictions, gaming establishments have sought to introduce new and exciting wagering games. In many instances, the new games have been implemented in an electronic medium. For example, slot machines and video poker machines have surpassed table games in both popularity and ability to generate casino profits. Nonetheless, a significant number of gamblers do not enjoy the inanimate interaction with a machine and the lack of required player skill. Therefore, new table games continue to be a necessary component of a successful casino.

The most successful and long-lasting table games to date have been Blackjack, Craps, Roulette and Pai Gow Poker. More recently, the table games of Caribbean Stud, Three Card Poker and Let it Ride have also become very popular. Thus, casinos are fully aware of the importance of new table games. As a result of the need for new table games, the number of U.S. patents directed to table games has steadily climbed. Unfortunately, in practice, the patented games have not been successful for many reasons. For example, ease of play, slow pace and high level of difficulty have prevented the implementation of many of the patented table games.

Pai Gow Poker is a wagering game played with 53 cards, which is the standard 52 card deck plus one joker, which can be used as an ace, or to complete a flush, straight flush or straight or as a wild card. In Pai Gow Poker each player and the dealer receive seven cards to divide into one five-card hand and one two-card hand. A two-card hand can be either a pair or two different cards. The players then must make a five-card hand with the seven cards which scores higher than the two-card hand. For example, if the seven cards include a pair of fives and a pair of sevens, the pair of sevens may be included in the five-card hand and the pair of fives in the two-card hand. If the player=s five-card hand beats the dealer=s five-card hand and the player=s two card hand beats the dealer=s two-card hand, the player wins. If the dealer=s five-card hand beats the player=s five-card hand and the dealer=s two-card hand beats the player=s two-card hand, the dealer wins. If the player and dealer each win one hand, the result is a push and the player=s original wager is returned. Should the player arrange his or her cards such that the player=s three-card hand fails to beat the player=s two-card hand, the player loses by default. It is further noted that any two-card or three-card hands which result in tie are resolved in favor of the dealer. Winning players are paid even money, less a commission percentage determined by the casino, on winning wagers.

While popular, Pai Gow Poker suffers from inherent shortcomings, including, but not limited to, slow paced play and an inability for players to win a large amounts of money. Evidenced by the proliferation of electronic gaming machines, the new gaming public seeks immediate resolution of their wagers and an opportunity at large jackpots. Thus, there is a continued desire for a table game which is fast-paced and offers an opportunity for larger payouts. Accordingly, the embodiments of the present invention address the shortcomings of Pai Gow Poker by modifying the game to both retain traditional gamblers and attract the new breed of gamblers.

SUMMARY

The shortcomings of traditional Pai Gow Poker are eliminated by reducing the number of cards utilized and offering tantalizing payouts based on the player's dealt cards. Rather than seven cards, the embodiments of the present invention utilize five cards which are arranged into a three-card hand and a two-card hand. In addition, a pay table based on the rank of the player's five cards in combination or the relationship between the individual two-card and three-card hands offers substantial winning opportunities.

In a first embodiment suitable for liberal gaming jurisdictions (e.g. Las Vegas), players place a primary wager and an optional secondary wager. Thereafter, the players and the dealer each receive five cards which are arranged into a three-card hand and two-card hand. The game is played with a standard fifty-two card deck. Optionally, a joker may be added to the standard deck which can be used as an ace, or to complete a flush, straight, straight flush or as a wild card. Similar to Pai Gow Poker, the player's three-card hand must outrank the player's two-card hand. With respect to the three-card hand, the hand rankings include a single high card, a pair, flush, straight, straight flush and three of a kind. The rankings of the two-card hand comprise pairs and single high cards. Once all players have arranged their cards, the dealer exposes his or her cards and arranges them according to preestablished house rules. Thereafter, each player's cards are compared to the dealer's cards to determine whether a win, lose or push has occurred. Players win and lose their primary wagers in a similar manner to Pai Gow Poker. Therefore, if the player wins both hands, the player wins, if the player loses both hands, the player loses, and if the player and dealer each win one hand, the player pushes the wager. Any two-card or three-card hands which result in tie are resolved in favor of the dealer. In some embodiments of the present invention, the two-card hand must have a ranking of five or higher to qualify. Otherwise, the player loses the primary wager.

Besides the primary wager, players are provided the option of placing a secondary wager related to a pay table setting forth preestablished winning combinations and corresponding payouts. For example, should the player's five cards form a straight, the player may be paid 15-1 on the secondary wager. The secondary wager is paid regardless of the results of the underlying game between the player and dealer. In certain embodiments, a bad beat jackpot may be integrated into the game. The bad beat jackpot is won by a player who receives a preestablished minimum strong hand yet fails to win the primary wager. For example, the bad beat jackpot may be won by a player holding a minimum of a pair of kings in the two-card hand and three of a kind in the three-card hand yet the player still loses the hand. Such an arrangement is invariably a winning hand, thus the term bad beat. The bad beat jackpot may or may not require a separate side wager, may be financed by a portion of each player's primary wager or may be financed by a player bank as set forth below.

In an alternative embodiment suitable for both liberal jurisdictions and conservative jurisdictions (e.g. California), the dealer does not receive cards but merely deals cards to the players and oversees game outcomes. In this embodiment, a player is selected to act as a player bank in a procedure similar to baccarat.

As set forth in more detail be low, in each of the embodiments of the present invention, the house may or may not derive revenue from the collection prior to each deal of the game or they may or may not collect a commission percentage from the winning wager. With only five cards having to be arranged, the embodiments of the present invention facilitate a fast pace of play. Moreover, the preestablished winning combinations and corresponding payouts provide a means for players to win larger amounts of money than with payouts only associated with the underlying game.

BRIEF DESCRIPTION OF THE DRAWINGS

FIG. 4 shows a first proposed pay table including preestablished winning combinations and corresponding payouts; and FIG. 5 shows a second proposed pay table including preestablished winning combinations and corresponding payouts.

DETAILED DESCRIPTION

Figure 1:
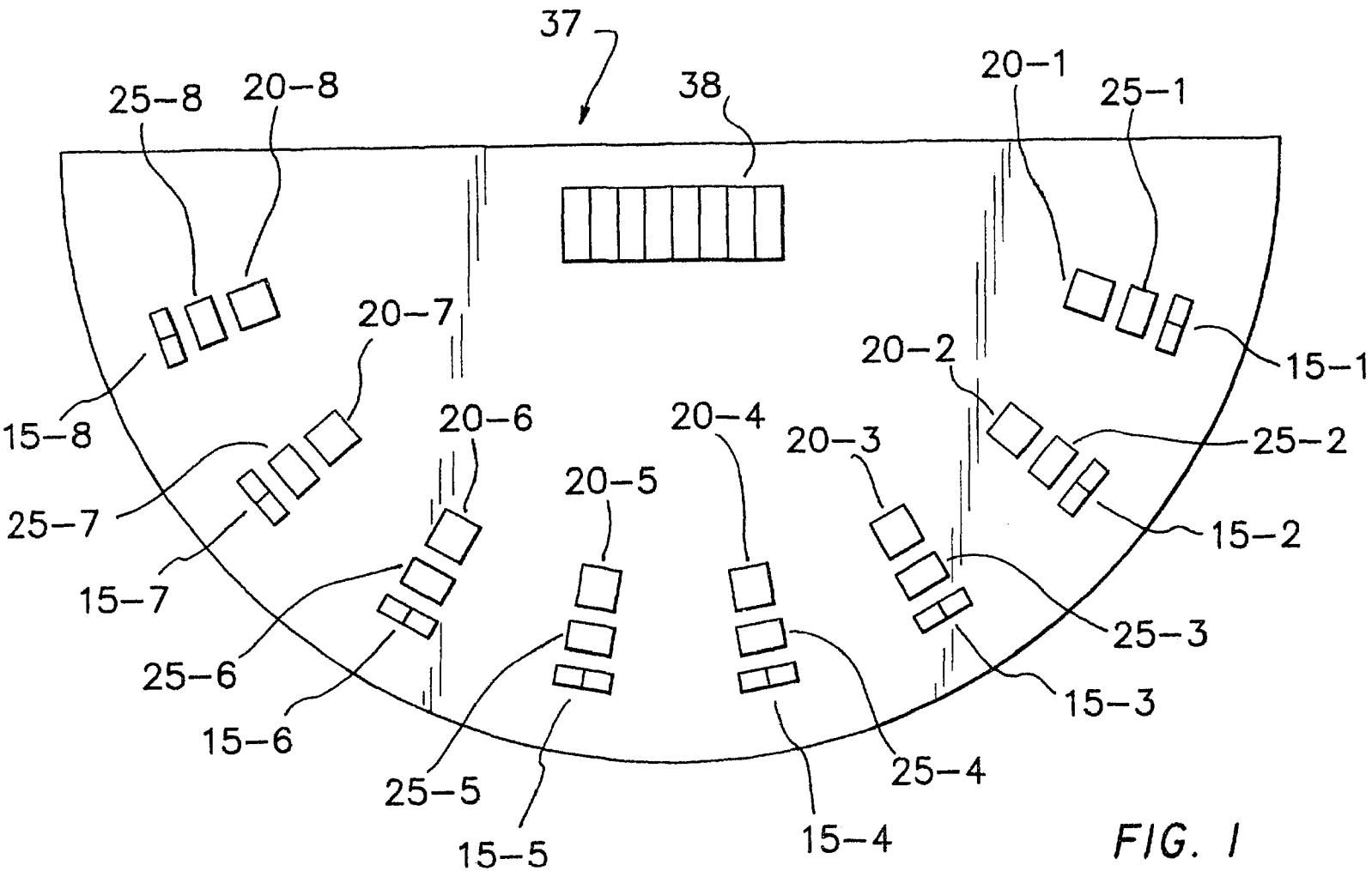
FIG. 1 shows a table layout designed to facilitate implementation of the embodiments of the present invention.

Reference is now made to the figures wherein like parts are referred to by like numerals throughout. FIG. 1 illustrates a table layout generally denoted as reference numeral 10. The layout 10 includes eight player positions 15-1 through 15-8 each having a two-card hand placement position 20-1 through 20-8, a three-card hand placement position 25-1 through 25-8, a primary wagering position 30-1 through 30-8 and a secondary wagering position 35-1 through 35-8. A dealer position 37 is adjacent a chip tray 38. Even though the layout 10 illustrates eight player positions 15-1 through 15-8 the embodiments of the present invention can be played by at least ten players simultaneously. While an amount of primary wagers will be dictated by the casino, it is contemplated that an amount of secondary wagers will be in a minimum/maximum range in a preestablished amount (e.g. $1-$5).

In traditional Pai Gow Poker and in at least a first embodiment of the present invention, one player is selected to be the recipient of the first pack of five cards from the shuffled deck. The random selection is made prior to the deal of the cards by using dice, dominos, a random number generator or other random selection means. In this fashion, a player is randomly selected to receive the first five cards from the shuffled deck. The remaining players receive their five card packs in a clockwise fashion starting from the selected player. The selected player is identified by a puck or other means suitable for identifying the randomly selected first player.

Figure 2:
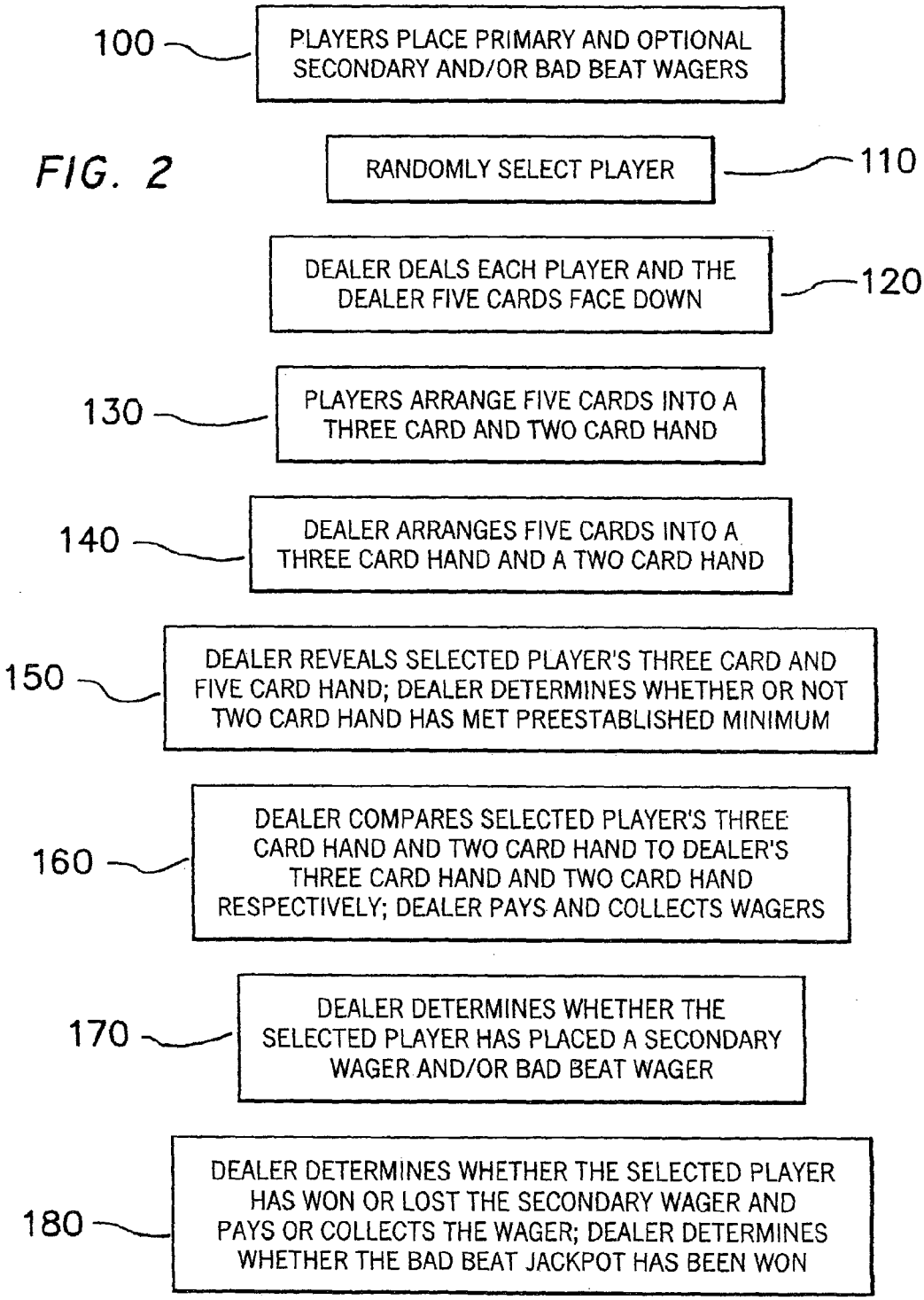
FIG. 2 shows a flowchart detailing a first embodiment of the present invention wherein players play against house.

FIG. 2 shows a flow chart detailing a first embodiment of the present invention wherein players play against a house. At step 100, players place their primary and optional secondary wagers. An amount of the primary wager is, preestablished by a casino conducting the embodiments of the present invention. For example, a casino may establish primary wagering limits between $5 and $100. Although an amount of the secondary wager is also preestablished by the casino, it is contemplated that the secondary wager will be a nominal amount, in a range such as $1-$5 per hand. The secondary wager is optional for each player. Optionally, players may also place individual bad beat wagers to be eligible for a bad beat jackpot.

At step 110, a player is randomly selected as the player to receive the first five cards from a shuffled deck of cards. Each other player and the dealer receives their five cards in a clockwise fashion starting with the selected player. At step 120, the cards are all dealt face down. At step 130, each player then looks at their cards and arranges them into a three-card hand and a two-card hand. Each player arranges their hands in a face down orientation. Once all players have arranged their cards, at step 140, the dealer arranges his or her cards, pursuant to a casino's preestablished rules, into a three-card hand and two-card hand in a face up orientation. At step 150, the dealer exposes the selected player's cards and first determines whether the two-card hand meets any preestablished minimum ranking (e.g. five or higher according to each casino establishment), if such a minimum ranking is implemented. If the preestablished minimum ranking is not achieved, the player loses the primary wager. At step 160, the dealer compares the selected player's three card hand and two card hand to the dealer's three card hand and two card hand, respectively, and determines whether the primary wager has been won, lost or pushed. If the player wins both hands, the player receives even money on the primary wager, if the player loses both hands, the dealer collects the primary wager and if the player wins one hand and loses the other hand, the player keeps the primary wager. Should the player and dealer tie any two-card or three-card hand, the tie is resolved in favor of the dealer. Thus, any play of the game involving a tie dictates that the player may only push, if the player wins the other hand, or lose, if the player loses the other hand.

Thereafter, at step 170, the dealer determines whether the selected player has placed a secondary wager and/or bad beat wager. If so, the dealer determines, at step 180, whether the selected player has won or lost the secondary wager and/or bad beat wager. To resolve the secondary wager, the dealer arranges the five cards into a single poker hand and compares the rank of the resultant poker hand to a preestablished pay table and the house pays the player accordingly. A proposed pay table with respect to the five card combinations is illustrated in FIG. 4. In an alternative embodiment, the relationship between the individual two-card hand and three-card hand determines whether the secondary wager has been won. For example, any pair in the two-card hand with a straight flush in the three-card hand may correspond to a winning combination set forth in a preestablished pay table. The dealer also determines if a bad beat jackpot has been won by any player losing the primary game. Steps 150 through 180 are then repeated in a clockwise fashion by the dealer for every other player.

As set forth in FIG. 2, the game utilizes less cards than traditional Pai Gow Poker so more hands can be played in a given time interval. The speed of play is conducive to generating more casino revenue than the slow-paced traditional Pai Gow Poker. Additionally, the secondary wager provides the casino with a large percentage advantage while offering players with an opportunity to win larger sums of money in return for a relatively small wager. While not shown, if desired, the house can also charge a commission on winning primary wagers. In addition, a surrender option provides that a player can surrender their hand should the hand be disappointing in strength. The surrender option requires the player to forfeit a portion of the player's original wager. For example, a player may have to forfeit one-half of the player's original wager in order to surrender the dealt hand.

Figure 3:
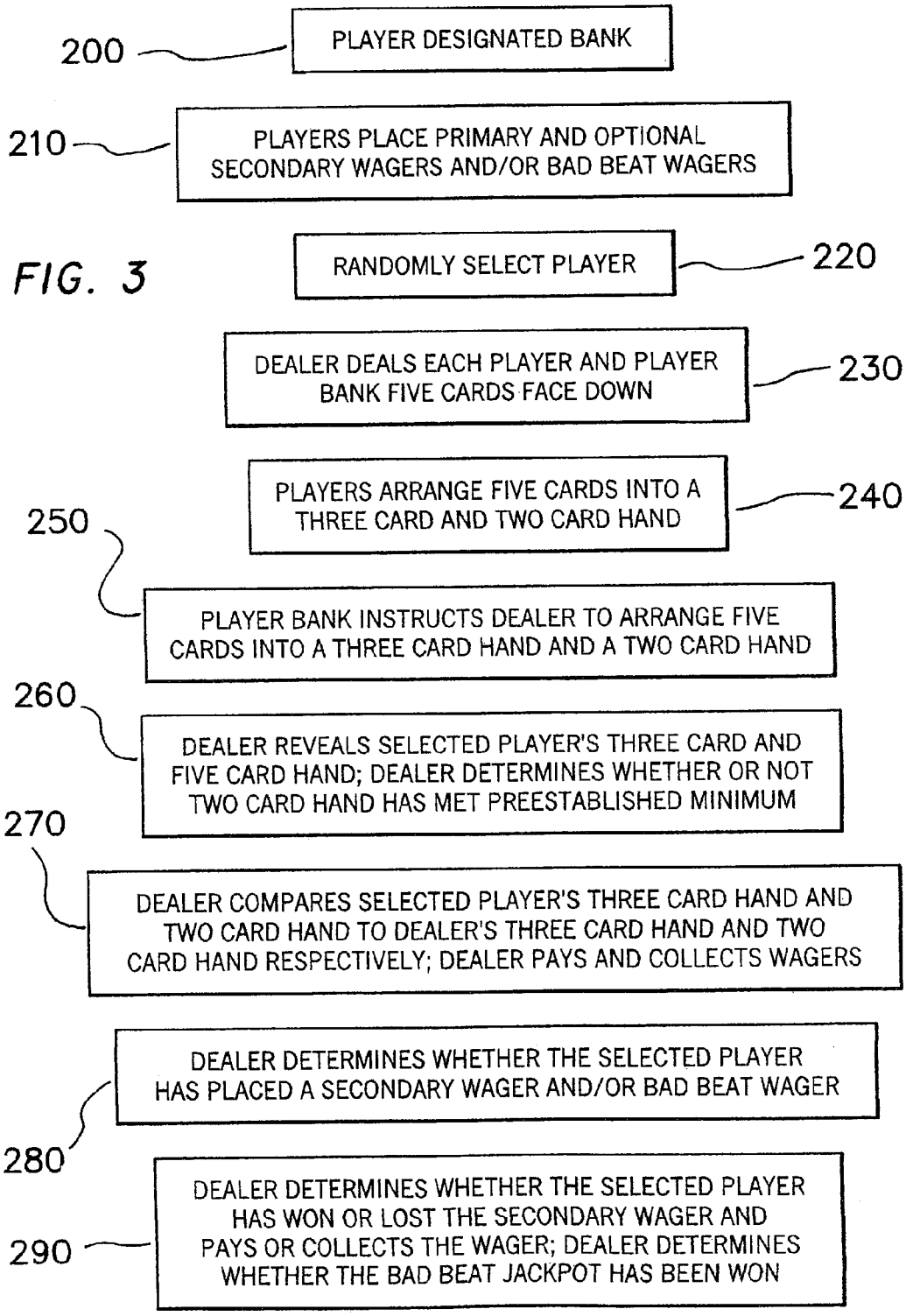
FIG. 3 shows a flow chart detailing an alternative embodiment of the present invention wherein players play against a player designated as the bank.

A flow chart detailing an alternative embodiment of the present invention is shown in FIG. 3. In the first alternative embodiment, at step 200, a player is designated to be a player bank. The designation is accomplished using any desired means. Thus, the non-designated players are now playing against the player bank rather than against the house. Thereafter, the players place their primary and optional secondary wagers at step 210. Optionally, players may also place individual bad beat wagers to be eligible for the bad beat jackpot or the player bank places a bad beat wager that causes all players to be eligible for the bad beat jackpot. Once all wagers have been placed, a player is selected to receive the first set of five cards from the shuffled deck at step 220. At step 230, the house dealer then deals the players and the player bank five face down cards, but does not deal himself or herself a hand. The players then arrange their cards at step 240. Once all players have arranged their cards, at step 250, the player bank instructs the dealer to arrange the cards of the player bank. Although the dealer may make suggestions as to the arrangement of the five cards, the player bank is not constrained by any preestablished rules of the casino. At step 260, the dealer exposes the selected player's cards and first determines whether the two-card hand meets any preestablished minimum ranking, if such a minimum ranking is implemented. If the preestablished minimum ranking is not achieved, the player loses the primary wager. At step 270, the dealer then compares the selected player's three-card hand and two-card hand to the player bank's three-card hand and two-card hand, respectively, and determines whether the primary wager has been won, lost or pushed. The rules of play are identical to the rules of the first embodiment. In other words, if the player wins both hands, the player receives even money on the primary wager, if the player loses both hands, the player bank collects the primary wager and if the player wins one hand and loses the other hand, the player keeps the primary wager. Should the player and dealer tie any two-card or three-card hand, the tie is resolved in favor of the dealer. Thus, any play of the game involving a tie dictates that the player may only push, if the player wins the other hand, or lose, if the player loses the other hand. In this arrangement, the player bank is responsible for paying and receiving winning and losing the players' primary wagers, respectively.

Thereafter, at step 280, the dealer determines whether the selected player has placed a secondary wager and/or bad beat wager. If so, the dealer determines, at step 290, whether the selected player has won or lost the secondary wager and/or bad beat wager. To resolve the secondary wager, the dealer arranges the five cards into a single poker hand and compares the rank of the resultant poker hand to a preestablished pay table and the house pays the selected player accordingly. In an alternative embodiment, the relationship between the individual two-card hand and three-card hand determines whether the secondary wager has been won. For example, any pair in the two-card hand with a straight flush in the three-card hand may correspond to a winning combination set forth in a preestablished pay table. The dealer also determines if a bad beat jackpot has been won by any player losing the primary wager. Steps 260 through 290 are then repeated by the dealer for every other player in a clockwise fashion. As set forth above, a surrender option may be implemented wherein the players, player bank or both may surrender their hands. Should the player bank surrender, the player bank is responsible for paying each player one-half of the wager made by each player. In other words, the players are each paid one-half of their wager amounts and the game is ended.

FIG. 4 illustrates a first proposed pay table 300 defining winning five-card combinations 310 and corresponding payouts 320 for the secondary wager. The payouts 320 set forth in the pay table 300 corresponds to a multiple of the secondary wager. As illustrated, the house retains better than an eighteen percent (18%) advantage with respect to the secondary wager. A second proposed pay table 400 shown in FIG. 5 defines winning combinations 410 and slightly varied corresponding payouts 420. By having a lower payout 430 corresponding to a royal flush, the house advantage becomes over nineteen and one-half percent (19.5%). Of course, casinos offering the embodiments of the present invention may revise the winning combinations 310, 410 and corresponding payouts 320, 420 to fit within the casino's particular circumstances and desires.

As disclosed above, casinos may desire to implement a proposed methodology for arranging the dealer's or player bank's cards. Similar to the hit and stand rules of blackjack, if implemented, the methodology herein described is to be followed by the dealer or player bank. The methodology is separated into six sub-parts depending on the cards received by the dealer. A proposed methodology is set forth below:

Non-Pair

If a three-card straight, straight flush or flush cannot be formed, the dealer must place the second and third highest ranking cards in the two-card hand. If a straight flush, straight or flush can be formed, the lowest ranking straight flush, straight or flush is held in the three-card hand and the remaining two cards are held in the two-card hand.

One Pair

If possible, remembering that the three-card hand must outrank the two-card hand, the pair is played in the two-card hand only if one can play flush, straight or straight flush in the three-card hand. If the pair in the two-card hand will outrank the three-card hand, play the pair, along with the lowest ranking card, in the three-card hand. If a straight flush, straight or flush can be formed using a single card from the pair, break up the pair and play the straight flush, straight or flush in the three-card hand. However, if breaking up the pair results in a front hand ranking less than queen high, play the pair in the three-card hand as long as the two-card has a ranking of queen or higher.

Two Pair

If a straight flush, straight or flush can be formed, play the straight flush, straight or flush in the three-card hand only when an ace is playable in the two-card hand. Otherwise, play the high pair in the three-card hand and the low pair in the two-card hand.

Three of a Kind

If possible, remembering that the three-card hand must outrank the two-card hand, play a pair in the two-card hand if one can play a flush, straight or straight flush in the three-card hand. If the hand includes three aces and two unmatched cards ranked less than a queen, play a pair of the aces in the three-card hand and a single ace, along with the highest unmatched card, in the two-card hand. Otherwise, play the three of a kind in the three-card hand.

Full House

Always play the three of kind in the three-card hand and the pair in the two-card hand.

Four of a Kind

Always split the four of a kind between the three-card hand and the two-card hand except if the remaining card is a Queen or higher. Then play three of a kind in the three-card hand and the remaining cards in the two-card hand.

It is noted that any casino implementing the embodiments of the present invention may develop its own set of preestablished rules to fit within the casino's particular circumstances and desires.

Although discussed in specific terms, it is contemplated that multiple decks may be used to implement the embodiments of the present invention. In addition, the one or more decks may be shuffled manually or by a machine and may be dealt from a dealer's hand or from a shoe.

The embodiments of the present invention may also be implemented into an electronic medium, such as an electronic video machine. Those skilled in the art understand that computer processors may be programmed to display and deal simulated card hands on a video screen or the like. A player then uses selection means, including buttons or touch screen technology, to arrange his or her cards and the processor arranges the simulated dealer's cards in a preprogrammed fashion. The processor then determines whether the player has won, lost or pushed the primary wager and further determines whether any secondary wager has been won or lost. Thereafter, the processor causes the player to be credited any winning amounts and deducts any losing amounts.

Although the embodiments of the present invention have been described in detail, additional variations and modifications exist within the scope and spirit of the invention as described and defined in the following claims.

We claim:

1. A method of playing a wagering game utilizing one or more decks of standard playing cards comprising:

accepting a primary wager from each participating player;

dealing each player and a dealer five cards;

requiring each player and the dealer to arrange the five cards into a three-card hand and a two-card hand wherein each player's two-card hand must achieve a minimum pre-established rank for each player to be eligible for a payout on the primary wager and wherein the dealer's hand is not required to achieve a minimum pre-established rank;

comparing the rank of the dealer's three-card hand to the rank of each player's three-card hand and comparing the rank of the dealer's two-card hand to the rank of each player's two-card hand; and settling each player's primary wager dependent upon the comparison of the rank of the dealer's three-card hand to the rank of each player's three-card hand and the comparison of the rank of the dealer's two-card hand to the rank of each player's two-card hand.

2. The method of claim 1 wherein the one or more decks include a joker which can be used as a wild card or to complete certain pre-established hands.

3. The method of claim 1 wherein the player loses and the player's primary wager is collected if the rank of the dealer's three-card hand and two-card hand outranks the player's three-card hand and two-card hand respectively.

4. The method of claim 1 wherein the player wins and the player receives a payout associated with the primary wager if the rank of the player's three-card hand and two-card hand outranks the dealer's three-card hand and two-card hand respectively.

5. The method of claim 1 wherein the player pushes and the player retains the primary wager if the rank of the player's three-card hand or two-card hand, but not both, outranks the dealer's three-card hand or two-card hand respectively.

6. The method of claim 1 wherein a tie between the player and dealer with regard to the rank of the three-card hand or two-card hand is resolved in favor of the dealer.

7. The method of claim 1 wherein the minimum pre-established rank is five high.

8. The method of claim 1 further including a step of accepting a secondary wager having a payout associated with pre-established ranking of each player's five cards in combination or the relationship between the two-card hand and three-card hand.

9. The method of claim 1 wherein said dealer must arrange the dealer's five cards in a pre-established manner.

10. The method of claim 1 wherein the player may surrender the five cards dealt by sacrificing a portion of the primary wager.

11. The method of claim 1 wherein a gambling establishment appropriates a percentage of each winning primary wager or a pre-established fee paid in advance of the deal as payment for conducting the wagering game.

12. A method of playing a wagering game utilizing one or more decks of standard playing cards comprising:

designating a single player as a bank;

accepting a primary wager from each participating player;

dealing each player and the designated player bank five cards;

requiring each player and the player bank to arrange the five cards into a three-card hand and a two-card hand wherein each player's two-card hand must achieve a minimum pre-established rank for each player to be eligible for a payout on the primary wager and wherein the dealer's hand is not required to achieve a minimum pre-established rank;

comparing the rank of each player's three-card hand to the rank of the player bank's three-card hand and comparing the rank of each players two-card hand to the rank of the player bank's two-card hand; and settling each player's primary wager dependent upon the comparison of the rank of each player's three-card hand to the rank of the player bank's three-card hand and the comparison of the rank of each player's two-card hand to the rank of the player bank's two-card hand.

13. The method of claim 12 wherein the one or more decks include a joker which can be used as a wild card or to complete certain pre-established hands.

14. The method of claim 12 wherein the player loses and the player's primary wager is collected by the player bank if both the rank of the player bank's three-card hand and two-card hand outranks the player's three-card hand and two-card hand respectively.

15. The method of claim 12 wherein the player wins and the player receives a payout associated with the primary wager if both the rank of the player's three-card hand and two-card hand outranks the player bank's three-card hand or two-card hand respectively.

16. The method of claim 12 wherein the player pushes and the player retains the primary wager if the rank of the player's three-card hand or two-card hand, but not both, outranks the player bank's three-card hand or two-card hand respectively.

17. The method of claim 12 wherein a tie between the player and player bank with regard to the rank of the three-card hand or two-card hand is resolved in favor of the player bank.

18. The method of claim 12 wherein the minimum pre-established rank is five high.

19. The method of claim 12 wherein the player bank settles the primary wager.

20. The method of claim 12 wherein a gambling establishment appropriates a percentage of each winning primary wager or a pre-established fee paid in advance of the deal as payment for conducting the wagering game.

21. The method of claim 12 wherein the player, player bank or both may surrender the five cards dealt by sacrificing a portion of the primary wager placed or banked.

22. A method of playing a wagering game utilizing one or more decks of standard playing cards comprising:

accepting a primary wager from each participating player;

accepting an optional secondary wager from each player;

dealing each player and a dealer five cards;

requiring each player and the dealer to arrange the five cards into a three-card hand and a two-card hand wherein each player's two-card hand must achieve a minimum pre-established rank for each player to be eligible for a payout on the primary wager and wherein the dealer's hand is not required to achieve a minimum pre-established rank;

comparing the rank of the dealer's three-card hand to the rank of each player's three-card hand and comparing the rank of the dealer's two-card hand to the rank of each player's two-card hand;

settling each player's primary wager dependent upon the comparison of the rank of the dealer's three-card hand to the rank of each player's three-card hand and the comparison of the rank of the dealer's two-card hand to the rank of each player's two-card hand; and settling each player's secondary wager dependent upon the rank of a hand formed of all five-cards or the relationship between the two-card hand and three-card hand.

23. A method of playing a wagering game utilizing one or more decks of standard playing cards comprising:

accepting a primary wager from each participating player;

dealing each player and a dealer five cards;

requiring each player and the dealer to arrange the five cards into a three-card hand and a two-card hand wherein each player's two-card hand must achieve a minimum pre-established rank for each player to be eligible for a payout on the primary wager and wherein the dealer's hand is not required to achieve a minimum pre-established rank;

comparing the rank of the dealer's three-card hand to the rank of each player's three-card hand and comparing the rank of the dealer's two-card hand to the rank of each player's two-card hand;

settling each player's primary wager dependent upon the comparison of the rank of the dealer's three-card hand to the rank of each player's three-card hand and the comparison of the rank of the dealer's two-card hand to the rank of each player's two-card hand; and if eligible, awarding each player a pre-established award dependent upon a rank of the player's five cards in combination or the relationship between the two-card hand and three-card hand.

24. An electronically implemented method of playing a wagering game comprising:

providing a processing unit, display screen and selection means;

accepting an inputted primary wager from a player;

displaying five player cards and five dealer cards;

the player using the selection means to arrange the player's five cards into a three-card hand and a two-card hand wherein the player's two-card hand must achieve a minimum pre-established rank for each player to be eligible for a payout on the primary wager and wherein the dealer's hand is not required to achieve a minimum pre-established rank;

said processing unit arranging the dealer's five cards into a three-card hand and a two-card hand;

said processing unit comparing the rank of the dealer's three-card hand to the rank of the player's three-card hand and comparing the rank of the dealer's two-card hand to the rank of the player's two-card hand; and said processing unit settling the player's primary wager dependent upon the comparison of the rank of the dealer's three-card hand to the rank of the player's three-card hand and the comparison of the rank of the dealer's two-card hand to the rank of the player's two-card hand.

25. The method of claim 24 further including a step of accepting an inputted secondary wager having a payout associated with a rank of a hand formed of all five-cards or the relationship between the two-card hand and three-card hand.

26. The method of claim 24 wherein the player may surrender the five cards dealt by sacrificing a portion of the inputted primary wager.

* * * * *